United States Patent [19]

Murakami et al.

[11] Patent Number: 4,945,324

[45] Date of Patent: Jul. 31, 1990

[54] THIN FILM FERROMAGNETIC RESONANCE TUNED FILTER

[75] Inventors: Yoshikazu Murakami; Takahiro Ohgihara; Kanako Niikura; Yasuyuki Mizunuma, all of Kanagawa; Hiroyuki Nakano, Tokyo, all of Japan

[73] Assignee: Sony Corporation, Tokyo, Japan

[21] Appl. No.: 326,430

[22] Filed: Mar. 17, 1989

Related U.S. Application Data

[63] Continuation of Ser. No. 127,014, Nov. 27, 1987, abandoned.

[30] Foreign Application Priority Data

Nov. 28, 1986 [JP] Japan ..... 61-283512
Apr. 30, 1987 [JP] Japan ..... 62-107350

[51] Int. Cl.[5] ..... H01P 1/20; H01P 1/218; H01P 1/217

[52] U.S. Cl. ..... 333/202; 333/205; 333/219.2

[58] Field of Search ..... 333/219, 219.2, 204, 333/205, 235, 161, 24.1, 202, 221, 222, 245, 246

[56] References Cited

U.S. PATENT DOCUMENTS 3,016,497 1/1962 Kostelnick ..... 333/204 X
3,611,197 10/1971 Moore et al. ..... 33/204 X
4,197,517 4/1980 Vittoria ..... 333/205
4,500,858 2/1985 Mezak ..... 33/202
4,679,015 7/1987 Murakami et al. ..... 333/219.2

FOREIGN PATENT DOCUMENTS 196918 10/1986 European Pat. Off. .
2131628 6/1984 United Kingdom .

OTHER PUBLICATIONS

1987 IEEE MTT-S International Microwave Symposium Digest, Jun. 1987, pp. 371-374.
Carter, IRE Transactions on Microwave Theory and Techniques, "Magnetically-Tunable Microwave Filters Using Single-Crystal Yttrium-Iron-Garnet Resonators", pp. 252-260, May 1961.
Simpson et al., The European Microwave Conference, "Tunable Microwave Filters Using YIG Grown by Liquid Phase Epitaxy", pp. 590-594, Sep. 13, 1974.

*Primary Examiner*—Eugene R. Laroche
*Assistant Examiner*—Seung Ham
*Attorney, Agent, or Firm*—Hill, Van Santen, Steadman & Simpson

[57] ABSTRACT

In a thin film ferromagnetic resonance tuned filter is disclosed which comprises a ferrimagnetic thin films, input and output signal transmission lines respectively coupled with the ferrimagnetic thin films, and a magnetic circuit for applying a DC magnetic field to the ferrimagnetic thin films, the present invention expands the variable frequency band by forming extensions each extending from the signal transmission line so that the distance from the coupling point of the signal transmission line coupled with the corresponding ferrimagnetic thin film to the grounded end thereof is 1/10 or above and less than ¼ the wavelength of a wave transmitted in the transmission lines at the upper limit frequency of a tuning frequency band. Further the deterioration of the isolation characteristics is suppressed by bending the extended portions not to form parallel portions to another transmission line.

8 Claims, 14 Drawing Sheets

THIN FILM FERROMAGNETIC RESONANCE TUNED FILTER

This is a continuation of application Ser. No. 127,014, filed Nov. 27, 1987 (now abandoned).

BACKGROUND OF THE INVENTION:

The present invention relates to a thin film ferromagnetic resonance tuned filter comprising, for example, a tuned filter using ferrimagnetic resonance of YIG thin film.

FIG. 9 diagrammatically illustrates a known thin film ferromagnetic resonance tuned filter employing ferromagnetic resonance thin films. The ferromagnetic resonance tuned filter is a two-stage band pass filter having a pair of YIG thin films $Y_1$ and $Y_2$ serving as magnetic resonators. An input signal transmission line $L_1$ and an output signal transmission line $L_2$ are magnetically coupled with the YIG thin films $Y_1$ and $Y_2$, respectively. A connecting transmission line $L_{1\ 2}$ extending across the input and output signal transmission lines $L_1$ and $L_2$ is coupled magnetically with the YIG thin films $Y_1$ and $Y_2$. The YIG thin films $Y_1$ and $Y_2$ are coupled with the signal transmission lines $L_1$ and $L_2$ at positions near the respective grounded ends $P_1$ and $P_2$ of the signal transmission lines $L_1$ and $L_2$, respectively, in order that the YIG thin films $Y_1$ and $Y_2$ are coupled strongly with the signal transmission lines $L_1$ and $L_2$, respectively.

In such construction the range of variation of the bandwidth is one to two octaves at most when a DC magnetic field applied to the YIG thin films $Y_1$ and $Y_2$ is varied to use the ferromagnetic resonance tuned filter as a variable frequency tuned filter.

The narrowness of the variation of the bandwidth of such a two-stage YIG tuning filter will be examined hereinafter. Suppose that the unloaded Q of each of the YIG thin films $Y_1$ and $Y_2$ is Qu, the external Q resulting from the coupling of the YIG thin films $Y_1$ and $Y_2$ respectively with the signal transmission lines $L_1$ and $L_2$ is Qe, the apparent external Q resulting from the extension of the distance between the coupling point of the input signal transmission line $L_1$ and the YIG thin film $Y_1$, and the grounded end $P_1$ and the distance between the coupling point of the output signal transmission line $L_2$ and the YIG thin film $Y_2$, and the grounded end $P_2$ is $Qe^{eff}$, and the coupling coefficient between the two YIG thin films $Y_1$ and $Y_2$ is k. Then, Qu, Qe, $Qe^{eff}$ and k are expressed by functions of frequency f as follows.

$$k=ko/f \tag{1}$$

$$Qu=(f-f_{min})/\gamma\Delta H\simeq f/\gamma\Delta H \tag{2}$$

$$Qe^{eff}=Qe/\cos^2\beta l=Qe/\cos^2(2\pi lf/Vc/\sqrt{\epsilon_{eff}}) \tag{3}$$

where $f_{min}$ is a lower limit resonance frequency, $\gamma$ is a gyromagnetic ratio, $\Delta H$ is a resonance linewidth, $\beta$ is the phase constant of the input and output signal lines, l is the distance between the respective coupling points of the input and output signal transmission lines and the corresponding YIG thin films and the respective grounded ends $P_1$ and $P_2$, Vc is the velocity of light, and $\epsilon_{eff}$ is the effective dielectric constant of the input and output signal transmission lines. Suppose that the filter is in the state of critical coupling at a frequency $f_0$. Then, the following equation is satisfied.

$$k=1/Qe^{eff}+1/Qu \tag{4}$$

In a state of critical coupling, the insertion loss of the filter reaches the minimum value while the reflection loss of the same reaches the maximum value at the center of the pass band.

However, in a state of overcoupling where $$k<1/Qe^{eff}+1/Qu \tag{5}$$

the filter characteristics is double humped, and hence the insertion loss is not minimum and the reflection loss is not maximum at the center of the pass band.

As undercoupling is enhanced in a state of undercoupling where $$k>1/Qe^{eff}+I/Qu \tag{6}$$

the insertion loss increases and the reflection loss decreases.

FIG. 10 shows the results of simulation characteristics tests of a filter basically having the constitution shown in FIG. 9. In FIG. 10, curves 10RL, 10IL and 10BW indicate the variation of the reflection loss, the insertion loss and a 3 dB bandwidth, respectively, with frequency. In this case, a critical frequency, namely, a frequency where the filter is in a state of critical coupling, is approximately 1 GHz. When the frequency decreases from the critical frequency, overcoupling is enhanced to deteriorate the filter characteristics, the insertion loss at the center of the pass band increases and the reflection loss at the center of the pass band decreases, and when the frequency increases from the critical frequency, undercoupling is enhanced to deteriorate the filter characteristics, the insertion loss increases and the reflection loss decreases, because the coupling coefficient k of the YIG thin films varies in proportion to frequency, while the distance l is sufficiently small and hence, as obvious from expression (3), $Qe^{eff}$ is fixed at Qe independently on frequency. As obvious from FIG. 10, when a required reflection loss is 10 dB or above, namely, when voltage standing wave ratio is 2 or below, the variable bandwidth is 0.65 GHz to 1.5 GHz, namely, 1.2 octaves and, when the reflection loss is 6 dB or above, namely, when the voltage standing wave ratio is 3 or below, the variable bandwidth is 0.5 GHz to 1.9 GHz, namely, 1.9 octaves. FIG. 11 shows the measured filter characteristics of this filter, in which curves 11RL, 11IL and 11BW indicate the variation of the measured reflection loss, the measured insertion loss and the measured 3 dB bandwidth. It is obvious that the curves shown in FIG. 11 resemble the corresponding curves shown in FIG. 10 closely.

Thus, in the known YIG thin film tuned filter, the 3 dB bandwidth varies greatly with the variation of the center frequency, which is unfavorable to the application of the YIG thin film tuned filter to a system, and the known YIG thin film tuned filter has a problem in spurious characteristics that the filter response is enhanced relatively by a spurious mode when the uniform mode of the YIG thin film resonance is a stat of undercoupling.

The present invention expands greatly the variable frequency band of the magnetic resonance tuning filter such as the foregoing YIG thin film magnetic resonance tuning filter, reduces the variation of the 3 dB bandwidth attributable to the variation of the center frequency, maintains the 3 dB bandwidth fixed over the entire range of variable frequency band to provide a magnetic resonance thin film tuning filter advantageous in application to a system. Furthermore, the present invention improves the spurious characteristics of the magnetic resonance thin film tuning filter so that the magnetic resonance thin film tuning filter has satisfactory spurious characteristics over the entire variable frequency band, by maintaining the magnetic resonance thin film tuning filter in a state close to critical coupling in most part of the variable frequency band and in a state of overcoupling at the upper and lower ends of the variable frequency band to suppress the deterioration of the spurious characteristics by undercoupling state.

OBJECT AND SUMMARY OF THE INVENTION

Accordingly, it is object of the present invention to provide an improved thin film ferromagnetic resonance tuned filter.

It is another object of the present invention to provide a thin film ferromagnetic resonance tuned filter having an expanded variable frequency band.

It is further object of the present invention to provide a thin film ferromagnetic resonance tuned filter having an expanded variable frequency band in which 3 dB bandwidth is stabilized.

It is still further object of the present invention to provide a thin film ferromagnetic resonance tuned filter having an improved isolation characteristics.

It is yet further object of the present invention to provide a thin film ferromagnetic resonance tuned filter having expanded variable frequency band in compact size.

According to one aspect of the present invention, there is provided a thin film ferromagnetic resonance tuned filter which comprises: a ferrimagnetic thin film, an input transmission line and an output transmission line coupled to said ferrimagnetic thin film, and a magnetic circuit applying DC magnetic field to said ferrimagnetic thin film, each of said input and output transmission lines being grounded at grounded end respectively, wherein each distance between a coupling point of said ferrimagnetic thin film and each of said input and output transmission lines and said grounded ends of each of said input and output transmission lines is selected one-tenth or above and less than one-fourth the wavelength of a wave transmitted in said transmission lines at an upper limit frequency of a turning bandwidth.

According to another aspect of the present invention, there is provided a thin film ferromagnetic resonance tuned filter which comprises:

a first and a second ferrimagnetic thin films, an input transmission line coupled to said first ferrimagnetic thin film and grounded at one end thereof, an output transmission line coupled to said second ferrimagnetic thin film and grounded at one end thereof, and a magnetic circuit applying DC magnetic field to said first and second ferrimagnetic thin films, wherein a distance between a coupling point of said first ferrimagnetic thin film and said input transmission line and said grounded end and a distance between a coupling point of said second ferrimagnetic thin film and said output transmission line and said grounded end are selected one-tenth or above and less than one-fourth the wavelength of a wave transmitted in said transmission lines at an upper limit frequency of a tuning bandwidth.

Further, the extended portions of the transmission lines may be bent not to form a parallel portion to another transmission line to improve isolation characteristics.

DESCRIPTION OF THE PREFERRED EMBODIMENTS

According to the present invention, the coupling of ferromagnetic resonance thin films, for example, YIG thin films, and input and output signal transmission lines is increased in a low frequency region and is decreased in a high frequency region to vary the coupling of the ferromagnetic resonance thin films with the input and output signal transmission lines with the frequency-dependent variation of the coupling coefficient k so that a state nearly the same as critical coupling is established over a wider frequency range and overcoupling is established at the opposite ends of a variable frequency band.

Figure 1:
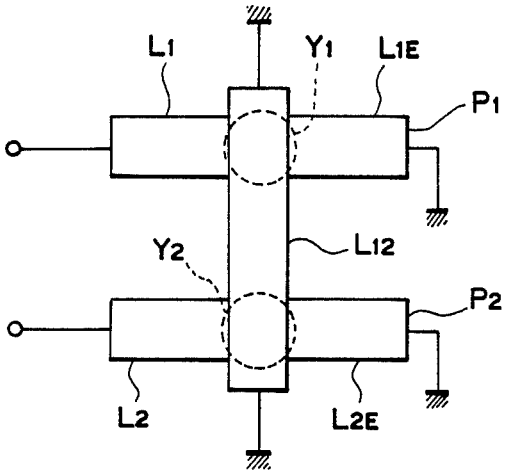
FIG. 1 is a diagrammatic illustration showing the basic constitution of a thin film ferromagnetic resonance tuned filter according to the present invention.

That is, in an YIG thin film tuned filter of the present invention, as shown in FIG. 1 illustrating the basic constitution thereof, comprising ferromagnetic YIG thin films $Y_1$ and $Y_2$ serving as magnetic resonators, an input signal transmission line $L_1$ and an output signal transmission line $L_2$ respectively coupled with the YIG thin films $Y_1$ and $Y_2$, and a magnetic circuit, not shown, for applying a DC magnetic field to the YIG thin films $Y_1$ and $Y_2$, the distances from the respective points of coupling of the input signal transmission line $L_1$ and the output signal transmission line $L_2$ with the YIG thin films $Y_1$ and $Y_2$ to the corresponding grounded ends $P_1$ and $P_2$ are one-tenth or above to less than one-fourth the wavelength of a wave at the upper limit frequency of a tuning frequency band. In FIG. 1, indicated at $L_{1\,2}$ is a coupling transmission line extending across the YIG thin films $Y_1$ and $Y_2$.

Figure 4:
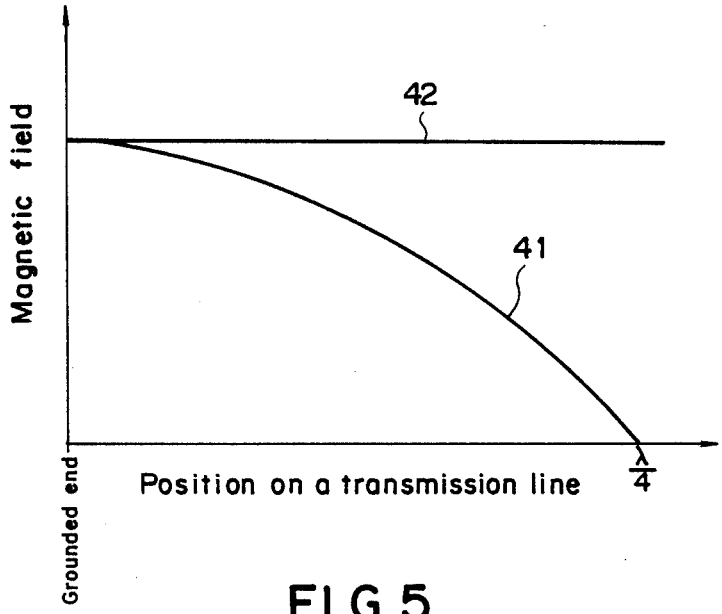
FIG. 4 is a graph showing the distribution of magnetic field on signal transmission lines.

Thus, according to the present invention, the distances from the respective points (center of YIG thin films $Y_1$ and $Y_2$) of coupling of the input signal transmission line $L_1$ and the output signal transmission line $L_2$ with the YIG thin films $Y_1$ and $Y_2$ to the corresponding grounded ends $P_1$ and $P_2$ are determined selectively at values in the range of one-tenth or above to less than one-fourth the wavelength of a wave at the upper limit frequency of a tuning frequency band. Accordingly, the coupling of the YIG thin films and the signal transmission lines is increased with the decrease of frequency and is decreased with the increase of frequency. That is, standing waves are generated in the transmission line grounded at one end thereof, and the distribution of the intensity of a high-frequency magnetic field generated by the signal transmission line is the highest at the grounded end and decreases cosine-functionally with distance from the grounded end to zero at a position at a distance corresponding to a quarter of the wavelength from the grounded end as indicated by a curve 41 in FIG. 4, while the distribution of the intensity of a low-frequency magnetic field generated by the signal transmission line is flat as indicated by a curve 42 in FIG. 4. Accordingly, in a magnetic resonance thin film tuning filter of the present invention, the degree of magnetic coupling of the YIG magnetic thin films and the signal transmission lines is high in the low frequency region of a variable frequency band and is low in the high frequency region of the same.

Suppose that the filter is in the state of critical coupling when the frequency is $f_0$. Then, from expression (4), $$k-1/Qu=1/Qe^{eff}$$

$$(k_0-\gamma\Delta H)/f_0=\cos^2\beta_0 l/Qe \quad (7)$$

Figure 5:
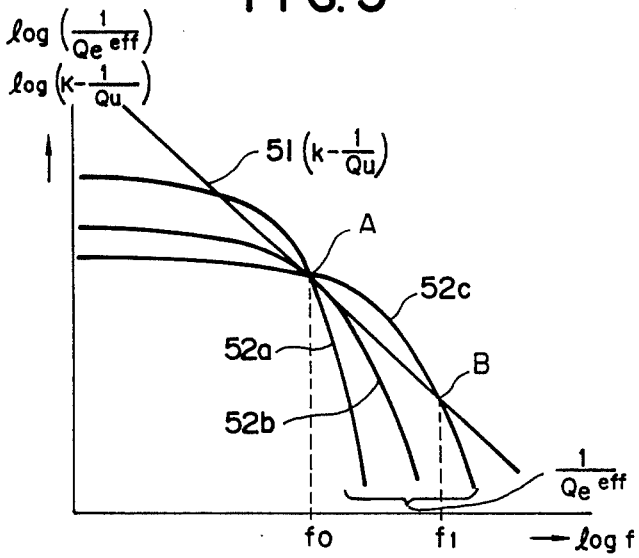
FIG. 5 is a graph showing the frequency dependency of $k-1/Qu$ and $1/Qe_{eff}$.

On the other hand, $k-1/Qu$ (log $(K-1/Qu)$) varies with frequency f (log f) along a straight line 51 as shown in FIG. 5. However, when the distance l from the point of coupling of the YIG thin films with the corresponding signal transmission lines to the respective grounded ends is less than a quarter of the wavelength, $1/Qe^{eff}$ varies with frequency f in three ways as represented by curves 52a, 52b and 52c in FIG. 5 depending on the value of the distance l.

Suppose that the variation of $1/Qe^{eff}$ is represented by the curve 52b. Then, the following equation (8) is satisfied $$d(k-1/Qu)/df=d(1/Qe^{eff})/df \quad (8)$$

Therefore, $$(k_0-\gamma\Delta H)/f_0^2=2\pi l/V_c/\sqrt{\epsilon_{eff}}\cdot \sin 2\beta_0 l/Qe \quad (9)$$

Substituting expression (7) into expression (9), we obtain $$\cos^2\beta_0 l=\beta_0 l\cdot\sin 2\beta_0 l \quad (10)$$

From expression (10), $\beta_0 l=0.761$. Therefore, $$l=\lambda_0/8.26 \quad (11)$$

where $\lambda_0$ is wavelength for frequency $f_0$. The variation of $1/Qe^{eff}$ with frequency when the distance l is larger than $\lambda_0/8.26$ is represented by the curve 52a, and by the curve 52c when the distance l is smaller than $\lambda_0/8.26$.

As obvious from FIG. 5, when $1/Qe^{eff}$ varies along the curves 52a or 52b, the frequency $f_0$ can be the upper limit frequency of the tuning frequency band. However, since a critical coupling mode appears again at a frequency $f_1$ higher than the frequency $f_0$ when $1/Qe^{eff}$ varies along the curve 52c, the frequency $f_0$ cannot be the upper limit frequency of the tuning frequency band of the filter. Accordingly, the effective range of the distance l is defined by $$\lambda_0/8.26\leqq l<\lambda_0/4 \quad (12)$$

However, in practical application, the frequency band can sufficiently be expanded when $$\lambda_0/10\leqq l<\lambda_0/4 \quad (13)$$

Figure 2:
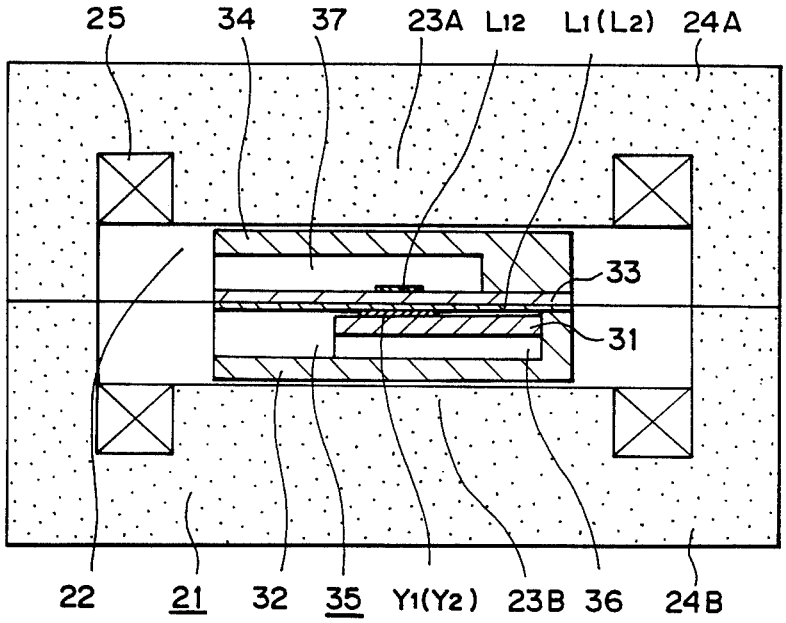
FIG. 2 is a sectional view of a thin film ferromagnetic resonance tuned filter, in a preferred embodiment, according to the present invention.
Figure 3:
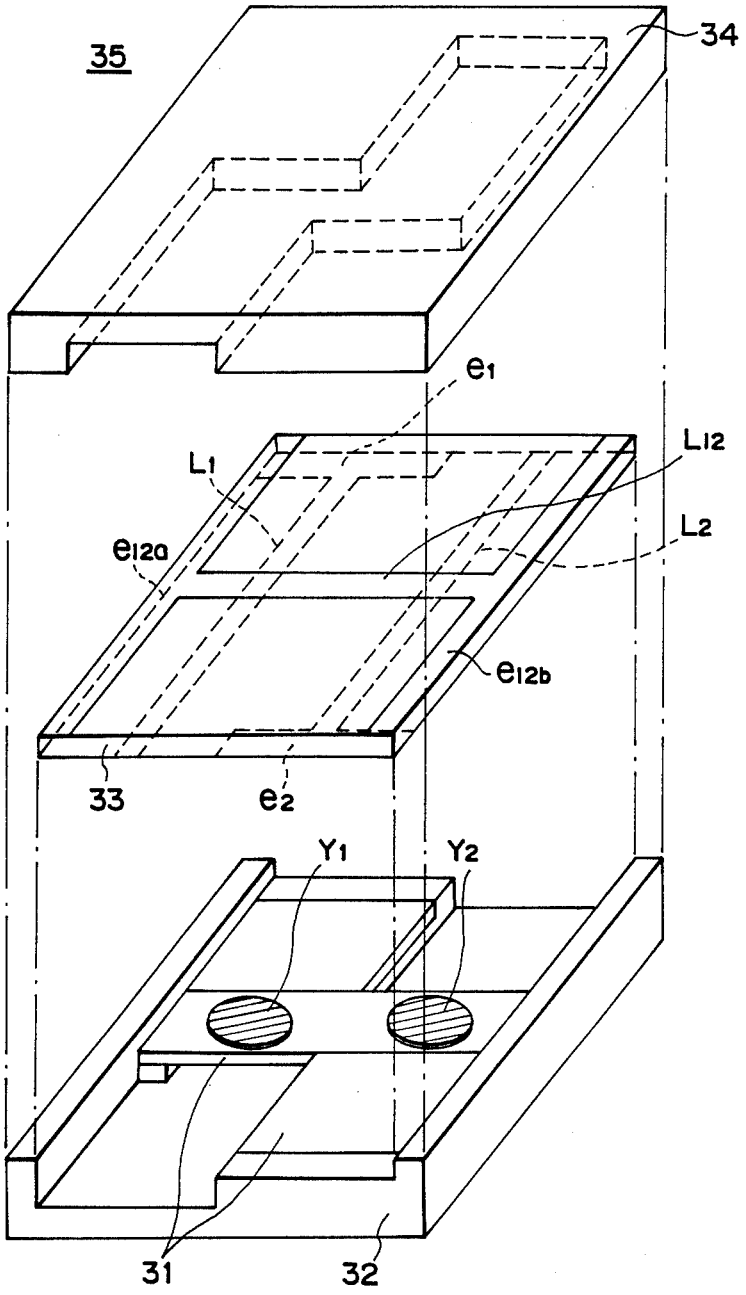
FIG. 3 is an exploded perspective view of a filter assembly incorporated into the tuned filter of FIG. 2.

An YIG thin film tuning filter, in a preferred embodiment, according to the present invention will be described hereinafter with reference to FIGS. 2 and 3. A disk-shaped YIG thin film $Y_1$ and a disk-shaped YIG thin film $Y_2$ are formed by forming an YIG thin film over the entire surface of a nonmagnetic substrate 31, for example, GGG (Gallium Gadolinium Garnet) substrate by a liquid-phase epitaxial growth process, and etching to form the YIG thin film through a photolithographic process. The nonmagnetic substrate 31 carrying the two YIG thin films $Y_1$ and $Y_2$ is placed on a lower conductor 32. A cavity is formed in a predetermined area in the lower conductor 32 to form an air gap 36 in an area corresponding to the YIG thin films $Y_1$ and $Y_2$ as shown in FIG. 2. A dielectric substrate 33, for example, a quartz substrate, is placed on the nonmagnetic substrate 31. Parallel input signal transmission line $L_1$ and an output signal transmission line $L_2$ are formed on one surface of the dielectric substrate 33 facing the YIG thin films $Y_1$ and $Y_2$ so as to extend across the YIG thin films $Y_1$ and $Y_2$, respectively. A connecting transmission line $L_{12}$ is formed on the other side of the dielectric substrate 33 transversely with respect to the direction of extension of the signal transmission lines $L_1$ and $L_2$ so as to extend over the YIG thin films $Y_1$ and $Y_2$. An upper conductor 34 is placed on the dielectric substrate 33 carrying the input signal transmission line $L_1$ and the output signal transmission line $L_2$ so as to hold the dielectric substrate 33 and the nonmagnetic substrate 31 carrying the YIG thin films $Y_1$ and $Y_2$ between the upper conductor 34 and the lower conductor 32 and so that the opposite side edges of the upper conductor 34 are disposed opposite to the opposite side edges of the lower conductor 32, respectively. A cavity is formed in a predetermined area in the inner surface of the upper conductor 34 to form an air gap 37 in an area corresponding to the YIG thin films $Y_1$ and $Y_2$, the input side of the input signal transmission line $L_1$ and the output side of the output signal transmission line $L_2$.

Grounding terminals $e_{12a}$ and $e_{12b}$ contacting the upper conductor 34 are formed at the Opposite ends of the connecting transmission line $L_{12}$ formed on the dielectric substrate 33 held between the lower conductor 32 and the upper conductor 34. Grounding terminals $e_1$ and $e_2$ are formed at the grounding end, namely, an end opposite the input end, of the input signal transmission line $L_1$ and at the grounding end, namely, an end opposite the output end, of the output signal transmission line $L_2$, respectively, so as to contact the lower conductor 32.

Thus, a filter assembly 35 comprising the YIG thin films $Y_1$ and $Y_2$, input and output signal transmission lines $L_1$ and $L_2$ coupled with the YIG thin films $Y_1$ and $Y_2$, and connecting transmission line $L_{12}$ which are provided between the upper and lower conductors 32 and 34 is constructed.

As illustrated in FIG. 2, the filter assembly 35 is disposed within a magnetic gap 22 of a magnetic circuit 21. The magnetic circuit 21 is constructed, for example, by disposing a pair of bell-shaped magnetic cores 24A and 24B respectively having central cores 23A and 23B opposite to each other so as to form a magnetic gap 22 between the central cores 23A and 23B. A coil 25 is wound at least on either the central core 23A or the central core 23B. A DC current is supplied to the coil 25 to apply a desired DC magnetic field to the filter assembly 35 disposed within the magnetic gap 22.

The intensity of the magnetic field is varied by varying the intensity of the DC current applied to the coil 25 to vary the tuning frequency.

The relative arrangement of the YIG thin films $Y_1$ and $Y_2$, and the input and output transmission lines $L_1$ and $L_2$ are determined so that the distance l from the coupling point of the YIG thin film $Y_1$ and the input transmission line $L_1$ to the grounding terminal $e_1$, and the distance l from the coupling point of the YIG thin film $Y_2$ and the output signal transmission line $L_2$ to the grounding terminal $e_2$ are 1/10 or above and less than $\frac{1}{4}$ the wavelength of a wave of the upper limit frequency.

When the signal transmission lines are formed on the GGG substrate as mentioned above to increase the effective dielectric constant of the signal transmission lines, clearances between the coupling point of the input signal transmission line L: and the YIG thin film $Y_1$, and the grounded end $e_1$ and between the coupling point of the output signal transmission line $L_2$ and the YIG thin film $Y_2$, namely, the actual distances, can be reduced.

Figure 6:
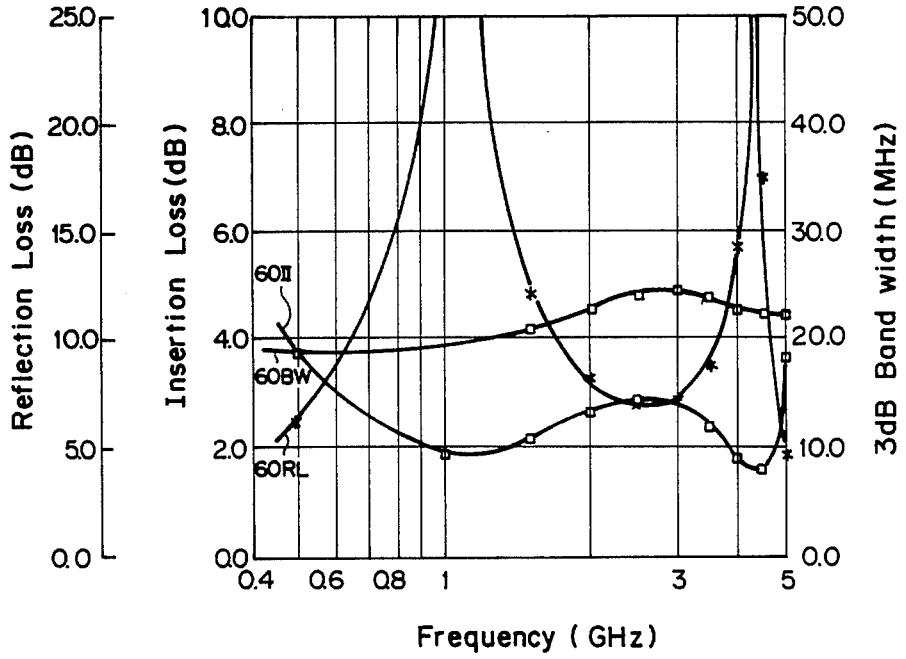
FIGS. 6 to 8 are graphs showing the filter characteristics of the thin film ferromagnetic resonance tuned filters of the present invention.

FIG. 6 shows filter characteristics obtained through a simulation test of a filter where the distance 1, namely, the distance from the coupling point of the input signal transmission line $L_1$ and the YIG thin film $Y_1$ to the grounded end $e_1$ and the distance from the coupling point of the output signal transmission line $L_2$ and the YIG thin film $Y_2$ to the grounded end $e_2$, corresponds to a clearance of 12.3 mm. In FIG. 6, curves 60RL, 60IL and 60BW represents the variation of reflection loss, insertion loss and 3 dB bandwidth, respectively, with frequency. In this case, the reflection loss is 6 dB or greater when the variable frequency band is from 0.5 GHz to 4.9 GHz, which is far greater than that of the known filter shown in FIGS. 10 and 11.

Figure 7:
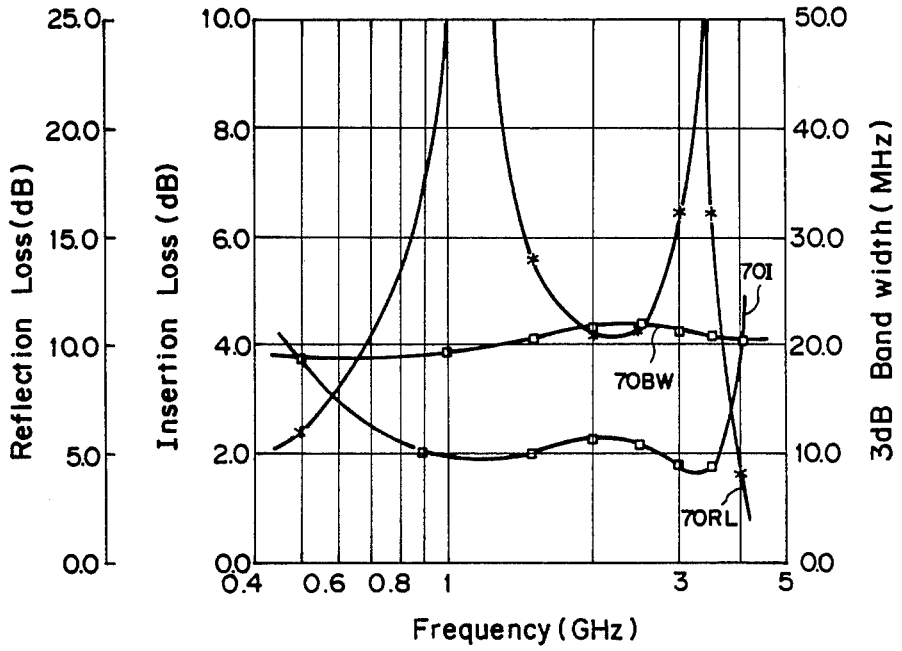
Figure 8:
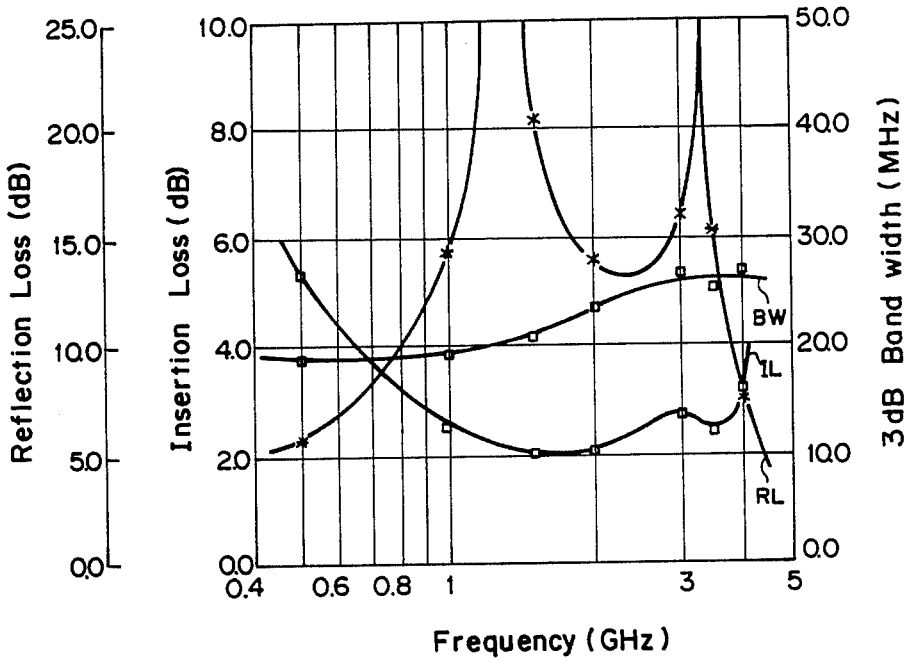

FIG. 7 shows filter characteristics obtained through a simulation test of a filter where the distance l corresponds to a clearance of 15.2 mm, in which curves 70RL, 70IL and 70BW represent the variation of reflection loss, insertion loss and 3 dB bandwidth, respectively, with frequency. In this case, a variable frequency band to provide a reflection loss of 10 dB or greater is 0.68 GHz to 3.76 GHz, namely, 2.4 octaves, and that to provide a reflection loss of 6 dB or greater is 0.5 GHz to 3.9 GHz, namely, 3 octaves. FIG. 8 shows the experimental filter characteristics of the filter of the present invention, corresponding to the filter characteristics of the known filter shown in FIG. 10. The filter characteristics determined through simulation agree well with the experimental filter characteristics shown in FIG. 8. The filter characteristics of FIG. 6 and those of FIG. 7 (FIG. 8) are obtained when the distance l corresponds to clearances of 12.3 mm and 15.2 mm, respectively. The clearances 12.3 mm and 15.2 mm correspond to 1/5 the wavelengths, namely, 80% of $\frac{1}{4}$ the wavelengths, at upper limit frequencies 4.9 GHz and 3.9 GHz, respectively.

Figure 10:
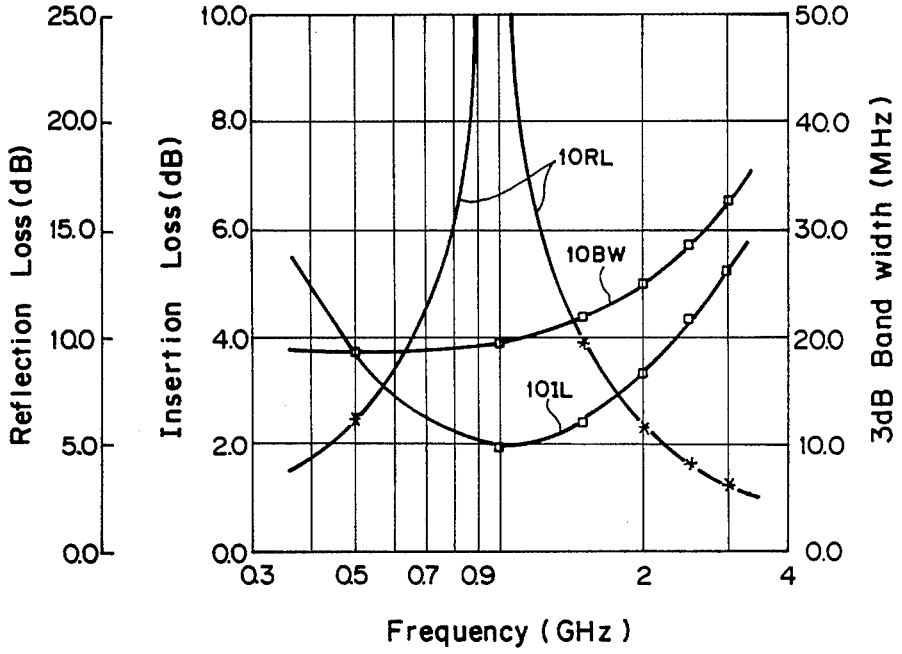
FIGS. 10 and 11 are graphs showing the filter characteristics of the YIG thin film tuned filters of FIG. 9.
Figure 11:
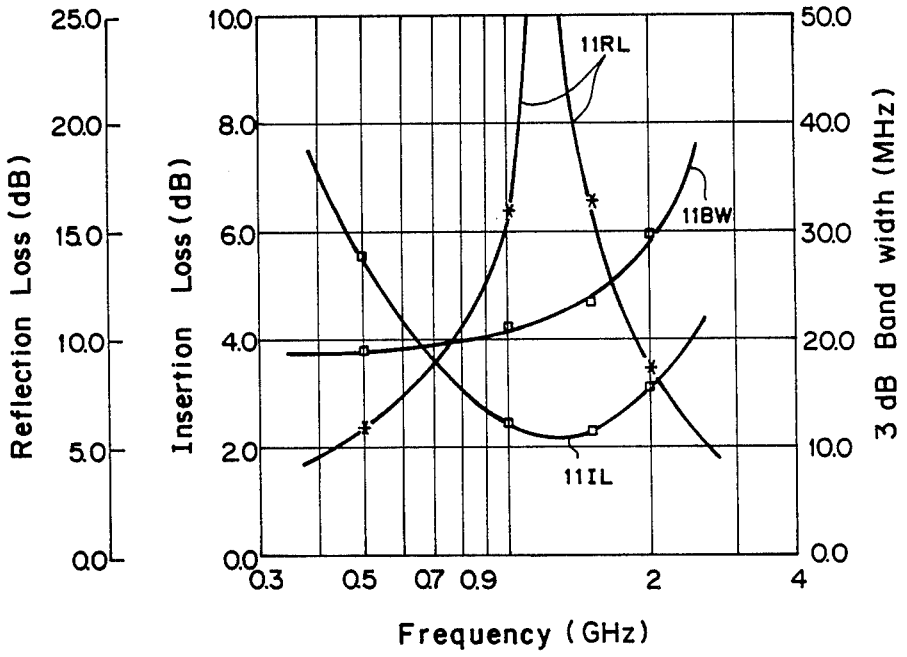

As obvious from the comparison of the filter characteristics of filters of the present invention shown in FIGS. 6 and 7 (FIG. 8) and those of the conventional filter shown in FIG. 10 (FIG. 11), in the filter of the present invention, the 3 dB bandwidth varies with the variation of the center frequency within a narrow range and is maintained substantially at a fixed value.

As apparent from the foregoing description, according to the present invention, the degree of coupling of the YIG thin films with the input and output signal transmission lines is increased in a low-frequency range and is decreased in a high-frequency range by selectively determining the distance from the coupling point of the YIG thin films and the input and output signal transmission lines to the respective grounded ends of the input and output signal transmission lines. Accordingly, as obvious from the relation between the curves 51 and **52*c* in FIG. 5, critical coupling occurs at frequencies $f_0$ and $f_1$ corresponding to two points A and B of intersection of the curves 51 and 52*c***, and hence a state nearly the same as critical coupling is established in a wide frequency range, so that the variable frequency band is expanded greatly. Furthermore, since overcoupling occurs at the opposite ends of the variable frequency band, the filter has satisfactory spurious characteristics over the entire variable frequency band. That is, the main mode of the YIG thin film filter is a uniform mode and the high-order magnetostatic mode is a spurious mode, and $Qe^u < Qe^s$ ($Qe^u$ is the external Q of the uniform mode and $Qe^s$ is the external Q of the spurious mode). Therefore, when the uniform mode tends to be the state of undercoupling, the spurious mode tends to approach the state of critical coupling, which relatively enhances the spurious response. Accordingly, as mentioned above, in the conventional YIG thin film filter, the uniform mode becomes a state of undercoupling in a high-frequency range, which deteriorates the spurious characteristics in the high-frequency range. On the contrary, in the YIG thin film filter of the present invention, a state nearly the same as the state of critical coupling appears in most part of the variable frequency band and a state of overcoupling appears at the opposite ends of the variable frequency band. Thus, the YIG thin film tuning filter of the present invention has satisfactory spurious characteristics over the entire variable frequency band.

Furthermore, according to the present invention, the range of variation of the 3 dB bandwidth with the variation of the resonance frequency is narrow, and hence the YIG thin film tuning filter of the present invention has a fixed 3 dB bandwidth over the entire variable frequency band, which is advantageous to application of the YIG thin film tuning filter to a system.

Figure 9:
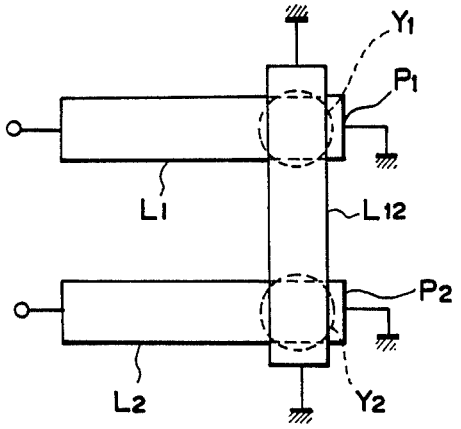
FIG. 9 (PRIOR ART)
FIG. 9 is a diagrammatic illustration showing the basic constitution of a known YIG thin film tuned filter.

Further embodiments will be explained hereinafter in which isolation characteristics of the above constructed filter is improved. As seen from the comparative observation of FIGS. 1 and 9, the enhancement of direct high-frequency magnetic coupling between the parallel transmission lines due to substantial increase in the respective lengths of the parallel portions of the input and output signal transmission lines by the provision of the extensions $L_{1E}$ and $L_{2E}$ is one of the causes of the deterioration of isolation characteristics. It is another cause of the deterioration of the isolation characteristics that the intensity of a high-frequency electric field is enhanced near the coupling parts of the input and output signal transmission lines coupled with the YIG thin films, namely, the magnetic resonance thin films, particularly at the upper limit frequency of a variable frequency band due to the provision of the extensions $L_{1E}$ and $L_{2E}$. This increases capacitive coupling with the COupling transmission line $L_{12}$.

Figure 12:
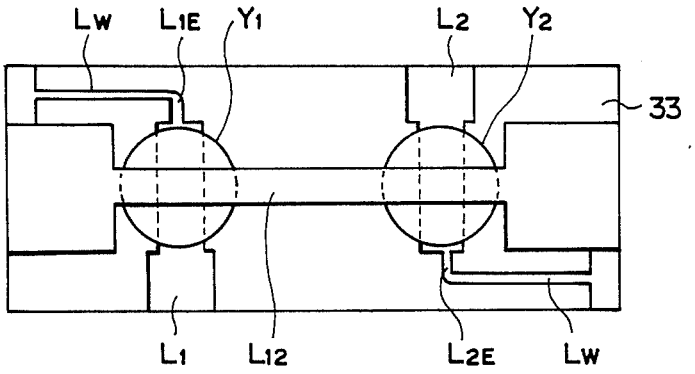
FIGS. 12 and 13 are enlarged diagrammatic plan views of the essential portions of filter assemblies employed in further embodiments of the filter according to the present invention, respectively.

FIG. 12 shows a plan view of the essential portion of the filter assembly. The filter assembly comprises ferrimagnetic thin films, that is, YIG thin films $Y_1$ and $Y_2$, serving as magnetic resonator, an input signal transmission line $L_1$ and an output signal transmission line $L_2$ respectively coupled with the YIG thin films $Y_1$ and $Y_2$, and a magnetic circuit, not shown, for applying a DC magnetic field to the YIG thin films $Y_1$ and $Y_2$, in which, as previously described with reference to FIG. 1, extensions $L_{1E}$ and $L_{2E}$ are extended from the ends of the input signal transmission line $L_1$ and the output signal transmission line $L_2$, respectively, so that the respective distances from the respective coupling parts of the input and output signal transmission lines to the grounded ends of the extensions are one-tenth or above and less than one-fourth, more specifically, nearly one-fourth the wavelength of a wave at the upper limit frequency of a tuning frequency band.

In this thin film ferromagnetic resonance tuned filter, at least the extensions $L_{1E}$ and $L_{2E}$ located on the same side as the coupling parts of the input signal transmission line $L_1$ and the output signal transmission line $L_2$ coupled with the YIG thin films $Y_1$ and $Y_2$, and the other ends of the input signal transmission line $L_1$ and the output signal transmission line $L_2$ respectively opposite the extensions $L_{1E}$ and $L_{2E}$ are bent, curved or gradually outwardly expanded to form interval increasing parts $L_w$ spaced apart from each other by a distance greater than the distance D between the respective coupling parts of the input signal transmission line $L_1$ and the output signal transmission line $L_2$.

Figure 13:
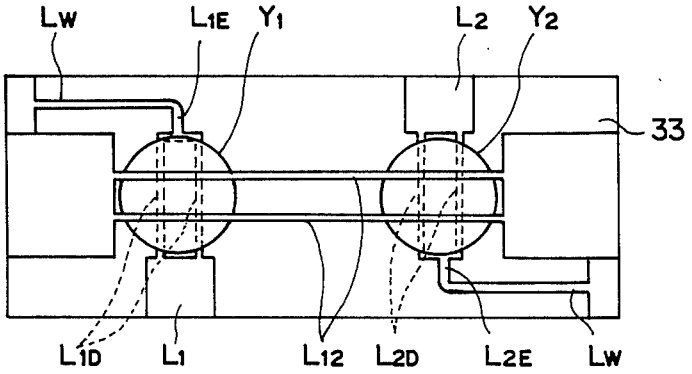

Furthermore, for example, as illustrated in FIG. 13, the coupling part of the input signal transmission line $L_1$ coupled with the YIG thin film $Y_1$ and/or the coupling part of the output signal transmission line $L_2$ coupled with the YIG thin film $Y_2$ is split into two longitudinal parts to form a split section $L_{1D}$ and/or a split section $L_{2D}$. In FIG. 13, parts corresponding to those shown in FIG. 12 are denoted by the same reference characters and the description thereof will be omitted to avoid duplication.

In such construction, interval increasing parts $L_w$ are formed in the extensions $L_{1E}$ and $L_{2E}$, respectively, so that the distance between the extension $L_{1E}$ and the other end of the signal transmission line $L_2$ and the distance between the extension $L_{2E}$ and the other end of the signal transmission line $L_1$ are greater than the distance between the rest of the portions of the signal transmission lines $L_1$ and $L_2$. Accordingly, the deterioration of high-frequency magnetic field isolation between the signal transmission lines $L_1$ and $L_2$ attributable to the provision of the extensions $L_{1E}$ and $L_{2E}$ is avoided.

Figure 16:
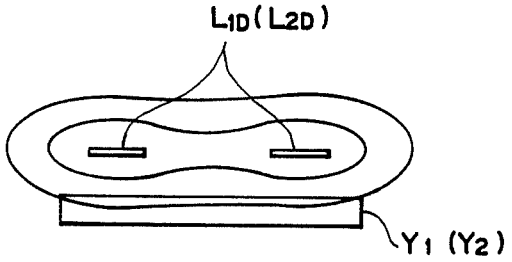
FIG. 16 is a diagrammatic illustration of the distribution of a magnetic field in the coupling part of the signal transmission line coupled with an YIG thin film.

Still further, when the split sections $L_{1D}$ and $L_{2D}$ are formed in the respective coupling parts of the signal transmission lines $L_1$ and $L_2$ coupled with the YIG thin films $Y_1$ and $Y_2$, respectively, magnetic flux is applied uniformly over the entire surfaces of the YIG thin films $Y_1$ and $Y_2$ with the impedances of the signal transmission lines $L_1$ and $L_2$ held constant, as illustrated by a magnetic flux distribution chart indicated by thin lines in FIG. 16. Accordingly, the enhancement of the capacitive coupling of the YIG thin films $Y_1$ and $Y_2$ with another transmission line, for example, the coupling line extending across the YIG thin films $Y_1$ and $Y_2$, due to the local enhancement of field strength is avoided, and thereby the isolation characteristics are improved.

Figure 14:
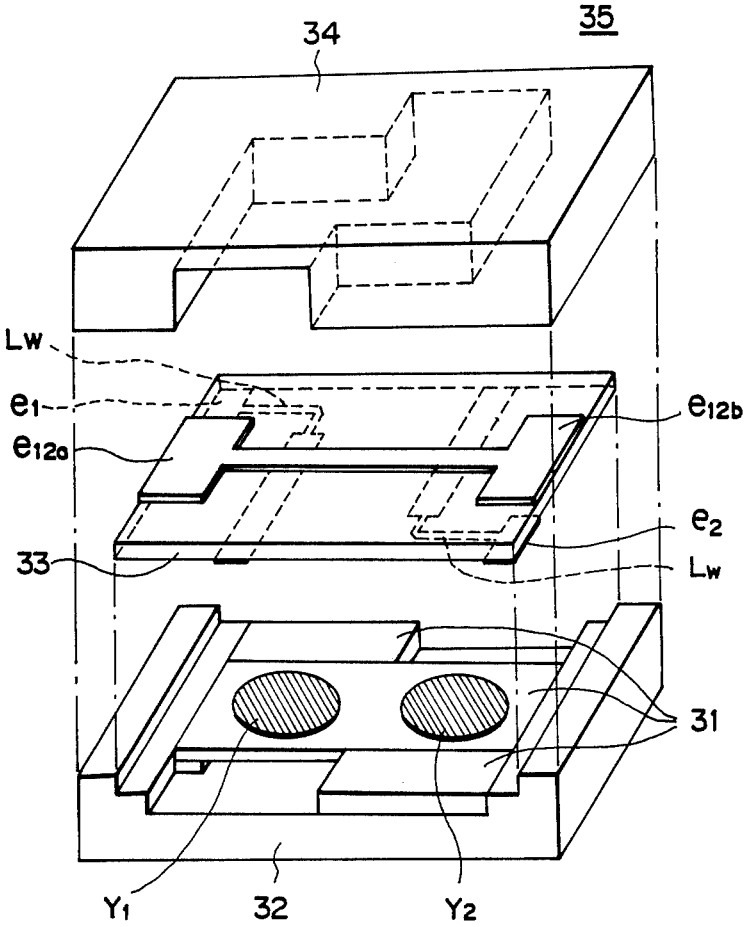
FIG. 14 is an enlarged schematic exploded perspective view of a filter assembly according to the present invention.
Figure 15:
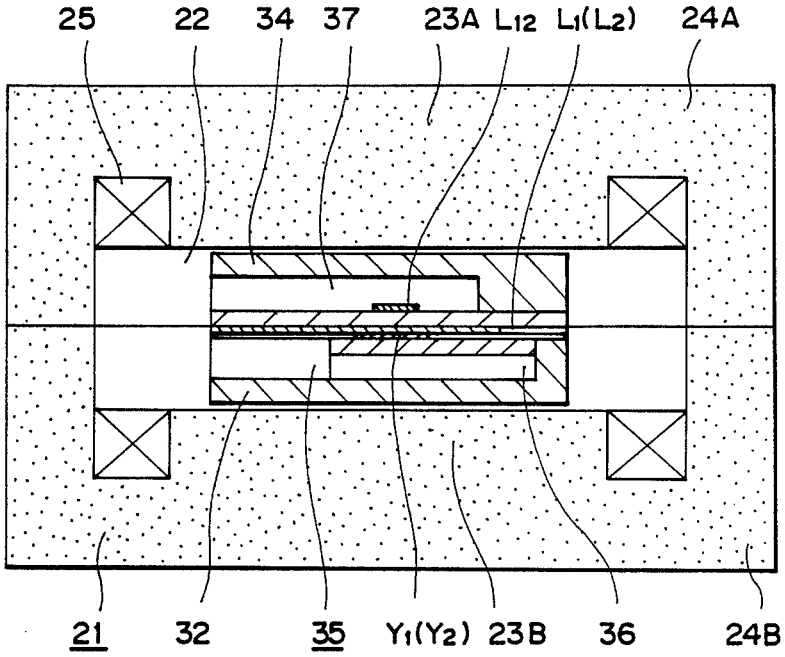
FIG. 15 is an enlarged schematic sectional view of a filter according to the present invention.

An YIG thin film tuning filter, in a preferred embodiment, according to the present invention will be described with reference to FIGS. 12, 14 and 15. A disk-shaped YIG thin film $Y_1$ and a disk-shaped YIG thin film $Y_2$ are formed by forming an YIG thin film over the entire surface of a nonmagnetic substrate 31, for example, a GGG (Gallium, Gadolinium Garnet) substrate by a liquid-phase epitaxial growth process, and etching to form the YIG thin film disk through a photolithographic process. The nonmagnetic substrate 31 carrying the two YIG thin films $Y_1$ and $Y_2$ is placed on a lower conductor 32. A cavity is formed in a predetermined area in the lower conductor 32 to form an air gap 36 opposite to the YIG thin films $Y_1$ and $Y_2$ as shown in FIG. 15. A dielectric substrate 33, for example, a GGG substrate, is placed on the non-magnetic substrate 31. Parallel input signal transmission line $L_1$ and an output signal transmission line $L_2$ are formed on one surface of the dielectric substrate 33 facing the YIG thin films $Y_1$ and $Y_2$ so as to extend across the YIG thin films $Y_1$ and $Y_2$, respectively. A coupling transmission line $L_{12}$ is formed on the other side of the dielectric substrate 33 transversely with respect to the direction of extension of the signal transmission lines $L_1$ and $L_2$ so as to extend over the YIG thin films $Y_1$ and $Y_2$. An upper conductor 34 is placed on the dielectric substrate 33 carrying the input signal transmission line $L_1$ and the output signal transmission line $L_2$ so as to hold the dielectric substrate 33 and the nonmagnetic substrate 31 carrying the YIG thin films $Y_1$ and $Y_2$ between the upper conductor 34 and the lower conductor 32 and so that the opposite side edges of the upper conductor 34 are disposed opposite to the opposite side edges of the lower conductor 32, respectively. A cavity is formed in a predetermined area in the inner surface of the upper conductor 34 to form an air gap 37 in an area corresponding to the YIG thin films $Y_1$ and $Y_2$, the input side of the input signal transmission line $L_1$ and the output side of the output signal transmission line $L_2$.

Grounding terminals $e_{12a}$ and $e_{12b}$ contacting the upper conductor 34 are formed at he opposite ends of the coupling transmission line $L_{12}$ formed on the dielectric substrate 33 held between the lower conductor 32 and the upper conductor 34. Grounding terminals $e_1$ and $e_2$ are formed at the grounding end, namely, an end opposite the input end, of the input signal transmission line $L_1$ and at the grounding end, namely, an end opposite the output end, of the output signal transmission line $L_2$, respectively, so as to contact the lower conductor 32.

Thus, a filter assembly 35 comprising the YIG thin films $Y_1$ and $Y_2$, input and output signal transmission lines $L_1$ and $L_2$ coupled with the YIG thin films $Y_1$ and $Y_2$, and coupling transmission line $L_{12}$ which are provided between the upper and lower conductors 32 and 34 is constructed.

As illustrated in FIG. 15, the filter assembly 34 is disposed within a magnetic gap 22 of a magnetic circuit 21. The magnetic circuit 21 is constructed, for example, by disposing a pair of bell-shaped magnetic cores 24A and 24B respectively having central cores 23A and 23B opposite to each other so as to form a magnetic gap 22 between the central cores 23A and 23B. A coil 25 is wound at least on either the central core 23A of the central core 23B. A DC current is supplied to the coil 25 to apply a desired DC magnetic field to the filter assembly 35 disposed within the magnetic gap 22.

The intensity of the magnetic field is varied by varying the intensity of the DC current applied to the coil 25 to vary the tuning frequency.

Extensions $L_{1E}$ and $L_{2E}$ are extended respectively from the input signal transmission line $L_1$ and the output signal transmission line $L_2$ so that the distances from the respective coupling parts of the signal transmission lines $L_1$ and $L_2$ coupled with the YIG thin films $Y_1$ and $Y_2$ to the respective grounded ends $e_1$ and $e_2$ are one-tenth or above and less than one-fourth the wavelength of a wave at the upper limit frequency.

In this embodiment, the extension $L_{1E}$ extending from one end of the input signal transmission line $L_1$, and the extension $L_{2E}$ extending from one end of the output signal transmission line $L_2$ extend in opposite directions with respect to each other, and the extensions $L_{1E}$ and $L_{2E}$ are bent outward, namely, away from each other, in an L-shape to form interval increasing parts $L_w$ therein, respectively, so that the distance between the extension $L_{1E}$ and the other end of the output signal transmission line $L_2$, and the distance between the extension $L_{2E}$ and the other end of the input signal transmission line $L_1$ are greater than the distance between the rest of the parts of the input signal transmission line $L_1$ and the output signal transmission line $L_2$. The respective outer corners of the bends of the interval increasing parts $L_w$ are cut diagonally to prevent reflection by the corners of the interval increasing parts $L_w$.

The lines $L_1$, $L_2$ and $L_{12}$ each may be split, for example, into two parts at the respective coupling parts coupled with the YIG thin films $Y_1$ and $Y_2$ to form split sections $L_{1D}$, $L_{2D}$ and $L_{12D}$ in the lines $L_1$, $L_2$ and $L_{12}$, respectively.

Although the extensions $L_{1E}$ and $L_{2E}$ respectively extending from the input signal transmission line $L_1$ and the output signal transmission line $L_2$ of this embodiment are bent in an L-shape to form the interval increasing parts $L_w$, the extensions $L_{1E}$ and $L_{2E}$ may be formed in an oblique pattern SO that the extensions $L_{1E}$ and $L_{2E}$ extend gradually away from the output signal transmission line $L_2$ and the input signal transmission line $L_1$, respectively. Furthermore, although the interval increasing parts $L_w$ are formed in the extensions $L_{1E}$ and $L_{2E}$ in this embodiment, it is also possible to form the interval increasing parts $L_w$ in both the extensions $L_{1E}$ and $L_{2E}$ and the corresponding ends of the output signal transmission line $L_1$ and the input signal transmission line $L_2$, or to form interval increasing parts $L_w$ only in the ends of the input signal transmission line $L_1$ and the output signal transmission line $L_2$ respectively located opposite to the extensions $L_{2E}$ and $L_{1E}$. Still further, in this embodiment, the respective grounded ends of the input signal transmission line $L_1$ and the output signal transmission line $L_2$ are opposite to each other with respect to the coupling parts of the signal transmission lines $L_1$ and $L_2$ coupled with the YIG thin films $Y_1$ and $Y_2$. However, if the grounded ends of the input signal transmission line $L_1$ and the output signal transmission line $L_2$ are on the same side with respect to the coupling parts, the extensions $L_{1E}$ and $L_{2E}$ are located opposite to each other. In such a case, the interval increasing part $L_w$ is formed only in either the extension $L_{1E}$ or $L_{2E}$, or the interval increasing parts $L_w$ are formed in both the extensions $L_{1E}$ and $L_{2E}$.

Furthermore, the coupling transmission line $L_{12}$ of this embodiment may be substituted by a third YIG thin film to be magnetically coupled with the YIG disk $Y_1$ and $Y_2$.

Figure 17:
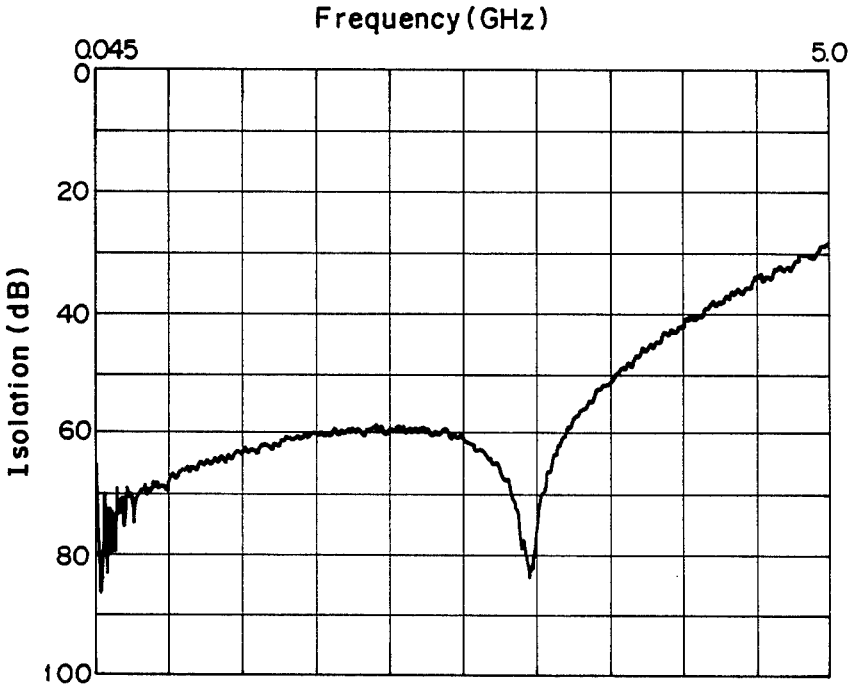
FIGS. 17 to 19 are graphs showing the isolation characteristics of filters.
Figure 18:
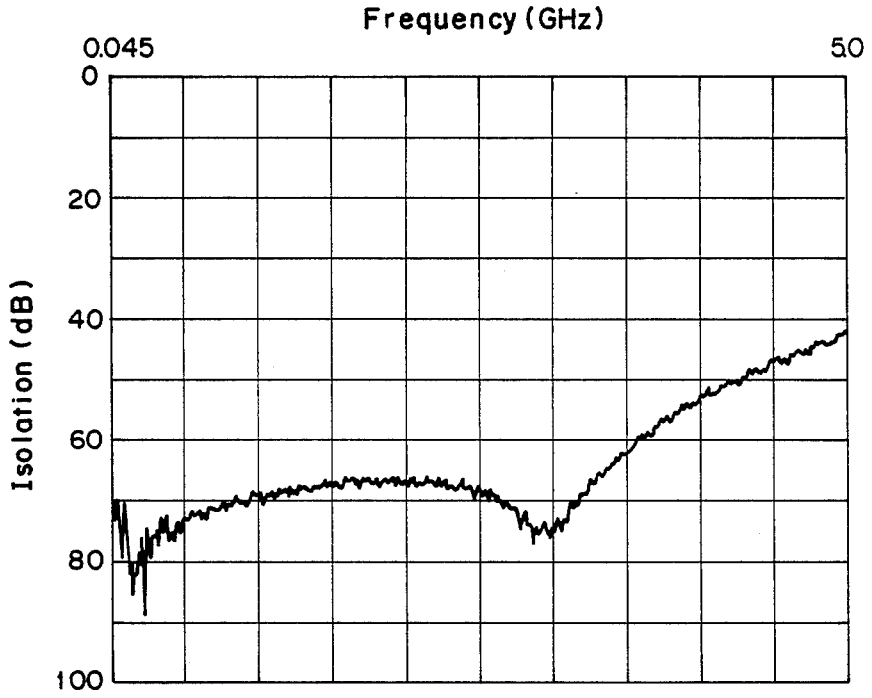
Figure 19:
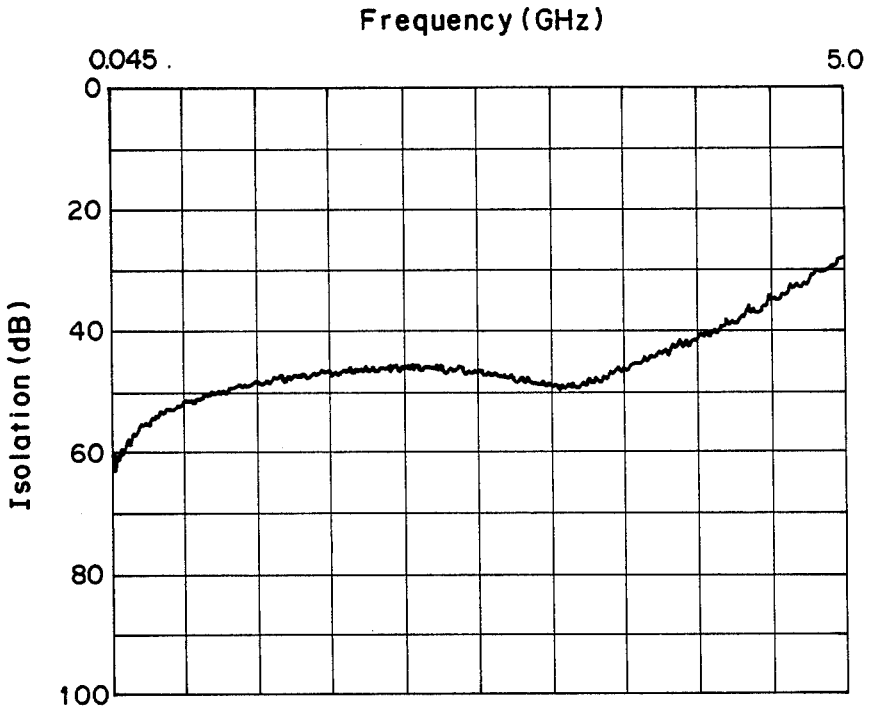

In the above embodiments, although the YIG thin film filter is provided with the extensions $L_{1E}$ and $L_{2E}$, the elongation of the lengths of the respective coincident portions of the input signal transmission line $L_1$ and the output signal transmission line $L_2$ is avoided, and the deterioration of the isolation characteristics due to the local concentration of electric field on the coupling part of the input signal transmission line $L_1$ coupled with the YIG thin film $Y_1$ and on the coupling pat of the output signal transmission line $L_2$ coupled with the YIG thin film $Y_2$ is avoided. FIGS. 17 and 18 show the isolation characteristics of filters according to the present invention respectively employing the filter assemblies respectively shown in FIGS. 12 and 13. FIG. 19 shows the isolation characteristics of an YIG thin film filter similar in construction to the YIG thin film filter shown in FIG. 12, except that extensions $L_{1E}$ and $L_{2E}$ are extended straight from the YIG thin films $Y_1$ and $Y_2$ without forming any interval increasing part $L_w$ therein. Although all these YIG thin film filters are variable frequency filters having a variable frequency bandwidth of three octaves in the range of 0.5 GHz to 4.0 GHz, as obvious from FIG. 19, the isolation is 40 dB at the upper limit frequency of 4 GHz, and is in the range of 45 to 50 dB in the frequency band below the upper limit frequency when the extensions $L_{1E}$ and $L_{2E}$ are straight. However, as obvious from FIGS. 17 and 18, the isolation of the YIG thin film filter employing the filter assembly of FIG. 12 is on the order of 40 dB at the upper limit frequency and is 60 dB or greater in the frequency band below the upper limit frequency, and the isolation of the YIG thin film filter employing the filter assembly of FIG. 13 is 50 dB or greater at the upper limit frequency of 4 GHz and is in the range of 65 to 70 dB in the almost entire range of the variable frequency band. Thus, the present invention improves the isolation characteristics.

Furthermore, as mentioned above, when the extensions $L_{1E}$ and $L_{2E}$ are straight, the area of the filter element, namely, the dielectric substrate 33, is as large as $10\times11.6$ mm$^2$, whereas the area of the filter element is as small as $12\times5$ mm$^2$ when the extensions $L_{1E}$ and $L_{2E}$ are bent in an L-shape. Thus, the present invention provides a compact thin film ferromagnetic resonance thin film tuning filter.

Still further, when the transmission lines $L_1$, $L_2$ and $L_{12}$ are split into longitudinal sections, uniform magnetic field is applied to the magnetic resonance YIG thin films $Y_1$ and $Y_2$ and thereby the spurious characteristics is improved.

We claim as our invention:

1. A thin film ferromagnetic resonance tuned filter comprising:

a ferrimagnetic thin film;

an input transmission line and an output transmission line coupled to said ferrimagnetic thin film; and a magnetic circuit applying DC magnetic field to said ferrimagnetic thin film, each of said input and output transmission lines being grounded at a grounded end respectively, wherein each distance between the center of said ferrimagnetic thin film and said grounded ends of each of said input and output transmission lines is selected one-tenth or above and less than one-fourth the wavelength of a wave transmitted in said transmission lines at an upper limit frequency of a tuning bandwidth.

2. A thin film ferromagnetic resonance tuned filter comprising:

a first and a second ferrimagnetic thin films;

an input transmission line coupled to said first ferrimagnetic thin film and grounded at one end thereof;

an output transmission line coupled to said second ferrimagnetic thin film and grounded at one end thereof; and a magnetic circuit applying DC magnetic field to said first and second ferrimagnetic thin films, wherein a distance between the center of said first ferrimagnetic thin film and said grounded end and a distance between the center of said second ferrimagnetic thin film and said grounded end are selected one-tenth or above and less than one-fourth the wavelength of a wave transmitted in said transmission lines at an upper limit frequency of a tuning bandwidth.

3. A thin film ferromagnetic resonance tuned filter according to claim 2, further comprises a connecting transmission line coupled to said first and second ferrimagnetic thin films.

4. A thin film ferromagnetic resonance tuned filter according to claim 2, further comprises a third ferrimagnetic thin film provided to be coupled with said first and second ferrimagnetic thin films.

5. A thin film ferromagnetic resonance tuned filter comprising:

ferrimagnetic thin films;

an input signal transmission line and an output signal transmission line respectively coupled with said ferrimagnetic thin films; and a magnetic circuit for applying a DC magnetic field to said ferrimagnetic thin films;

characterized in that one end of said input signal transmission line and one end of said output signal transmission line are extended to form extensions, the distance from the center of the ferrimagnetic thin film coupled with said input signal transmission line to the grounded end of the extension of said input signal transmission line, and the distance from the center of the ferrimagnetic thin film coupled with said output signal transmission line to the grounded end of the extension of said output signal transmission line being one-tenth or above and less than one-fourth the wavelength of a wave transmitted in said transmission lines at the upper limit frequency of a tuning frequency band, and that parts spaced apart by an interval greater than the interval between the center of the ferrimagnetic thin film coupled with said input signal transmission line and the center of the ferrimagnetic thin film coupled with said output signal transmission line, are provided at least in either the said extensions located on the same side as the coupling points of said input and output signal transmission lines coupled with the corresponding magnetic resonance thin films, or the mutually opposite other corresponding parts of said input and output signal transmission lines.

6. A thin film ferromagnetic resonance tuned filter comprising:

ferrimagnetic thin films;

an input signal transmission line and an output signal transmission line respectively coupled with said ferrimagnetic thin films; and a magnetic circuit for applying a DC magnetic field to said ferrimagnetic thin films;

characterized in that one end of said input signal transmission line and one end of said output signal transmission line are extended to form extensions, the distance from the center of the ferrimagnetic thin films coupled with said input signal transmission line to the grounded end of said extension, and the distance from the center of the ferrimagnetic thin film coupled with said output signal transmission line to the grounded end of said extension, being one-tenth or above and less than one-fourth the wavelength of a wave transmitted in said transmission lines at the upper limit frequency of a tuning frequency band, that a divided part is formed at least in either the coupling portion of said input signal transmission line or the coupling portion of said output signal transmission line, and that parts spaced apart by an interval greater than the interval between the input signal transmission line and the center of the ferrimagnetic thin film coupled with said output signal transmission line, are provided at least in either the said extensions located on the same side as the centers of the ferrimagnetic thin films, or the mutually opposite other corresponding parts of said input and output signal transmission lines.

7. A thin film ferromagnetic resonance tuned filter according to claims 5 or 6, further comprises a connecting transmission line coupled to said first and second ferrimagnetic thin films.

8. A thin film ferromagnetic resonance tuned filter according to claims 5 or 6, further comprises a third ferrimagnetic thin film provided to be coupled with said first and second ferrimagnetic thin films.

* * * * *